US007159503B1

(12) United States Patent
Weatherwax

(10) Patent No.: US 7,159,503 B1
(45) Date of Patent: Jan. 9, 2007

(54) MODULAR, LIGHT WEIGHT, BLAST PROTECTIVE, CHECK POINT STRUCTURE

(76) Inventor: John Weatherwax, Cutting Edge Metal Specialties, 1278 Logan Ave., Costa Mesa, CA (US) 92626

( * ) Notice: Subject to any disclaimer, the term of this patent is extended or adjusted under 35 U.S.C. 154(b) by 0 days.

(21) Appl. No.: 11/181,191

(22) Filed: Jul. 13, 2005

(51) Int. Cl.
*F41H 5/24* (2006.01)

(52) U.S. Cl. ..... 89/36.04; 86/50; 89/36.07

(58) Field of Classification Search ..... 89/36.04, 89/36.07; 52/1, 169.6, 79.5, 69–71, 64, 33, 52/36.1–36.2, 79.1, 23, 63, 167.3, 79.9; 404/6; 86/50

See application file for complete search history.

(56) References Cited

U.S. PATENT DOCUMENTS 4,589,341 A 5/1986 Clark et al.
4,647,246 A 3/1987 Brink et al.
4,780,020 A * 10/1988 Terio ..... 404/6
4,979,817 A * 12/1990 Crisp, Sr. ..... 256/13.1
5,719,350 A 2/1998 Parkes et al.
5,993,104 A * 11/1999 Marcotullio et al. ..... 404/6
6,873,920 B1 3/2005 Dunleavy et al.

FOREIGN PATENT DOCUMENTS

GB 2337805 1/1999
WO WO 2004/092543 10/2004
WO WO 2005/040714 5/2005

* cited by examiner

*Primary Examiner*—Michael J. Carone
*Assistant Examiner*—Gabriel J. Klein
(74) *Attorney, Agent, or Firm*—Gene Scott, Patent Law & Venture Group

(57) ABSTRACT

An explosion protective shelter apparatus comprises a pair of spaced apart upright parallel walls without rigid structural interconnection. The walls supported by the ground surface so as to define a vehicular space between them. The walls are joined by elastic members or secured against shock absorbers. The walls are easily erected on site and placed in service where personnel may be sheltered from an exploding vehicle that is being inspected between the walls.

20 Claims, 5 Drawing Sheets

MODULAR, LIGHT WEIGHT, BLAST PROTECTIVE, CHECK POINT STRUCTURE

BACKGROUND

1. Field of the Present Disclosure

This disclosure relates generally to explosion-proof structures and more particularly to a structure designed for use in inspecting vehicles that may contain explosives or may be an explosion hazard.

2. Description of Related Art

Clark et al., U.S. Pat. No. 4589341, discloses an improved method of blast suppression that involves forming an expanded foam barrier and teaches various barrier structures and methods for suppression of a blast wave. Brink et al., U.S. Pat. No. 4647246, discloses a pit that is normally bridged by a generally flat platform, a continuation of a roadway. The plate is pivoted at the unsecured side and supported at the protected side by a weight-responsive removable or frangible support so that an unapproved vehicle will cause the support to give 'way and let the platform swing down and thereby entrap the vehicle in a pit. Terio, U.S. Pat. No. 4780020, discloses a terrorist vehicle barrier comprising two vertical I-beams having a cable passed between them. An expanded aluminum honeycomb is provided to provide an effective shock absorbing structure. Parkes et al., U.S. Pat. No. 5719350, discloses a rupturable flexible liquid containment device for controlling "fly" from building demolition, the disposal of munitions, the disposal of used but unexploded weapons and the suppression of terrorist bombs. Dunleavy et al., U.S. Pat. No. 6873920, discloses a blast fragment and oxygen fire safety barrier comprising a corrugated impact panel connected to and spanning a pair of columns designed by directly impacting the barrier with a fragment of specified weight at a specified velocity to obtain test values for use in determining whether the barrier is capable of absorbing impact kinetic energy (KE) without exceeding predetermined maximum allowable ductability and maximum allowable deflection to span ratios, and dissipating strain energy at such maximum allowable deflection, and whether connectors have sufficient shear strength considering the lesser of maximum dynamic shear capacity of said column and a maximum dynamic shear force based on measured peak reaction during direct fragment impact on the column. Parkes, G.B. 2337805, discloses an explosion-suppressing barrier that comprises a rigid frame such as a collapsible easel. A polythene saddlebag is suspended over the easel to form two water-filled bags. Alder, W.O. 2004/092543, discloses a prefabricated modular blast and/or anti-ram barrier wall to create vehicle standoff, withstand a high explosive blast and/or large vehicle impact. The wall may be specifically designed for blast at a very close standoff distance for which it greatly reduces the blast load overpressure on the objects (e.g., target building) set behind it and/or prevent entry by high-velocity large vehicles by absorbing high energy impacts. James, W.O. 2005/040714, discloses a blast mitigating structure comprising one or more rigid free-standing frames of one or more channel sections. Each frame being adapted to receive one or more rupturable containers adapted to contain liquid to thereby form a protective tunnel around a vehicle.

In summary, the prior art shows, a variety of apparatuses designed to mitigate blast. However, the prior art fails to teach an easily erected shelter that can be transported to a selected location and placed in service quickly by a minimum of personnel. The present disclosure distinguishes over the prior art providing heretofore unrealized advantages as described in the following summary.

SUMMARY

An explosion protective shelter comprises a pair of spaced apart upright parallel walls able to move in rotation about their lower edges upon experiencing a blast between them. The walls define a vehicular space. The walls, being modular, are easily erected on site and placed in service to provide shelter to personnel at a vehicular traffic check point where vehicles are forced to drive between the walls and stop for inspection. Drivers would exit vehicles and open all the doors and the trunk to permit security personnel to initially inspect the vehicle behind the walls.

A primary objective inherent in the above described apparatus and method of use is to provide advantages not taught by the prior art.

Another objective is to provide a blast protective shelter that is easily moved from place to place and light enough to erect quickly with two or three workers.

A further objective is to provide such a shelter that accommodates a blast between spaced apart walls by outward rotation against spring restraining forces.

Other features and advantages of the described apparatus and method of use will become apparent from the following more detailed description, taken in conjunction with the accompanying drawings, which illustrate, by way of example, the principles of the presently described apparatus and method of its use.

BRIEF DESCRIPTION OF THE DRAWINGS

The accompanying drawings illustrate at least one of the best mode embodiments of the present apparatus and method of it use. In such drawings.

DETAILED DESCRIPTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 1:
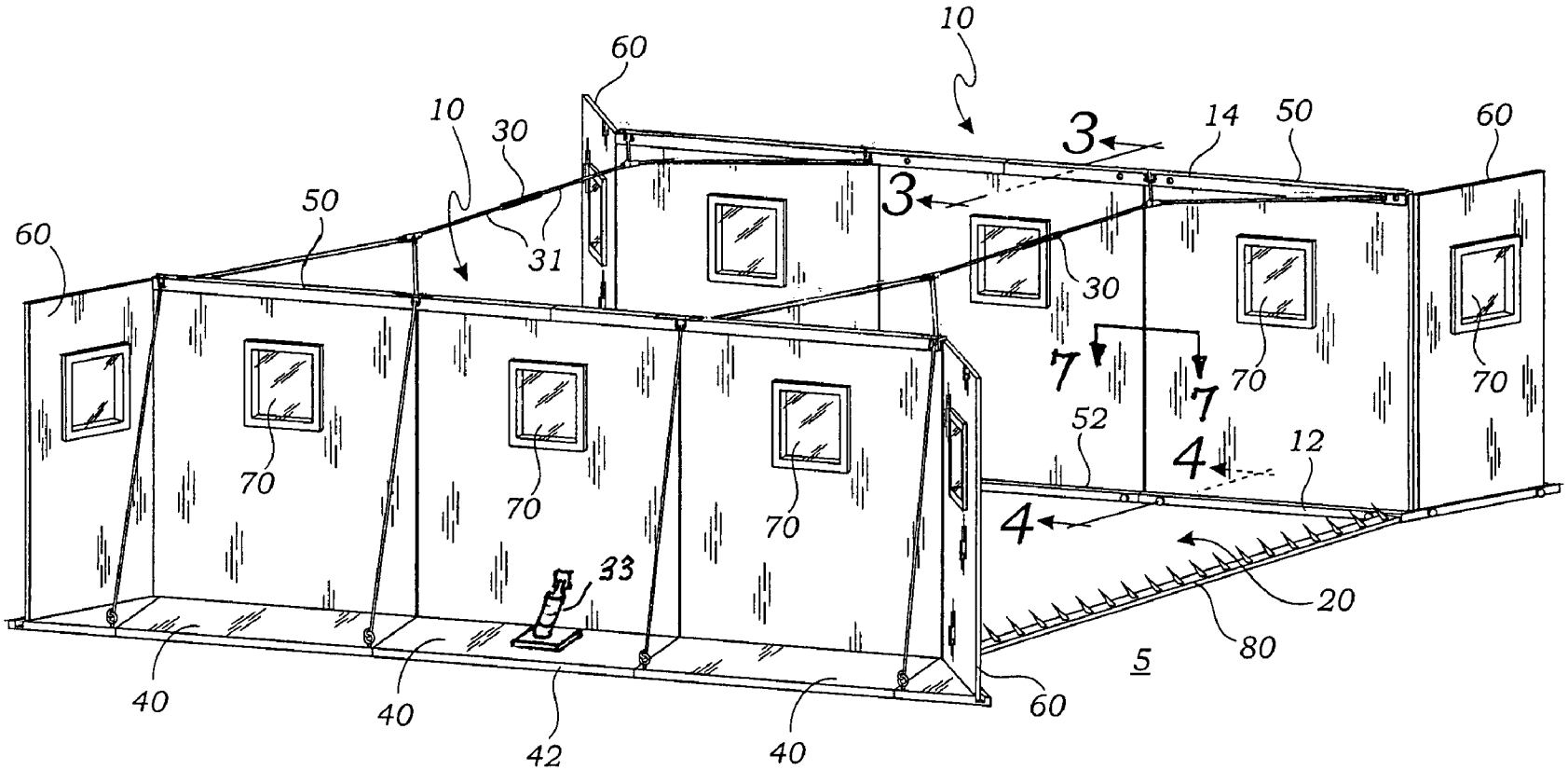
FIG. 1 is a perspective view of an embodiment of the apparatus.
Figure 5:
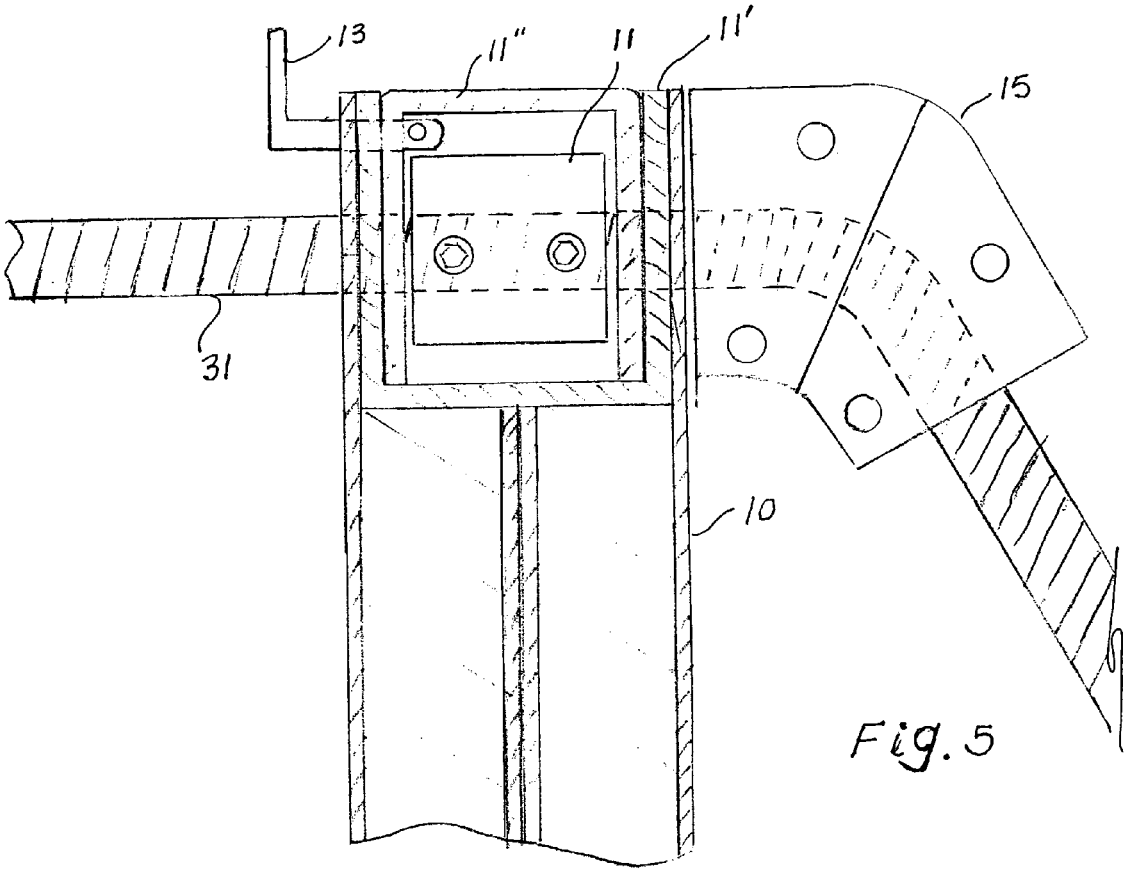
FIG. 5 is a partial section view taken along line 3—3 in FIG. 1 and showing a alternate construction and means for engaging a cable.
Figure 8:
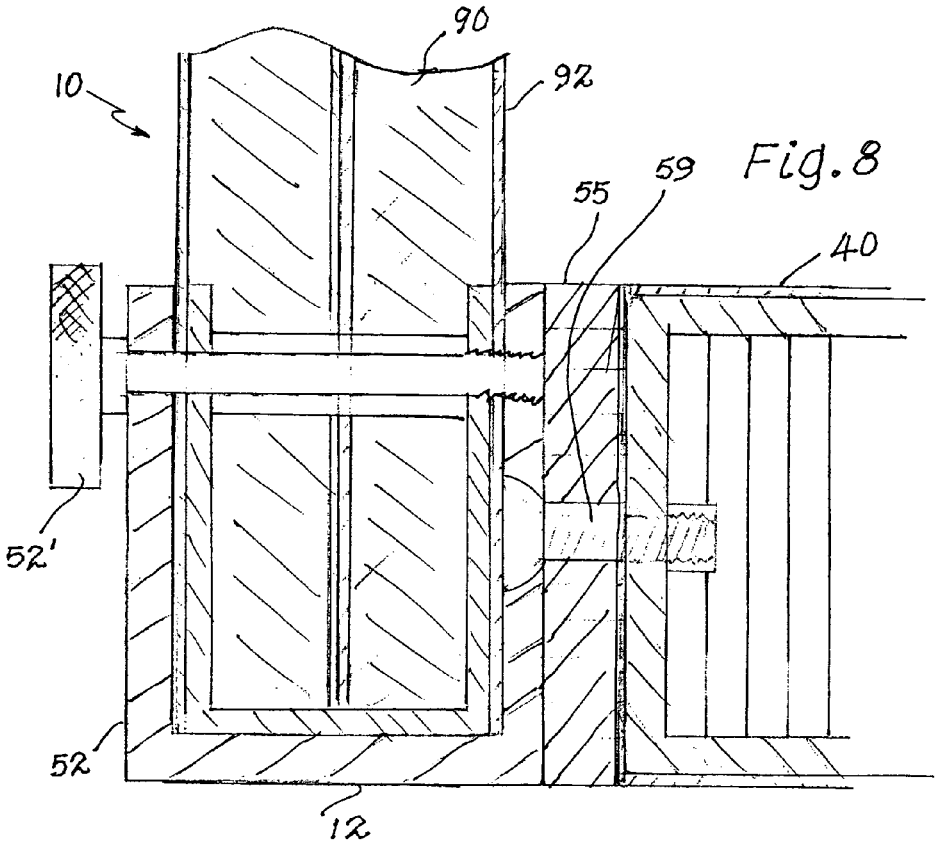
FIG. 8 is a partial sectional view taken along line 4—4 in FIG. 1 showing an alternate enablement to that of FIG. 4.

The present apparatus is an explosion protective shelter used for protecting inspection personnel at a vehicular check point in a war zone or other location where a vehicle may contain explosives. The apparatus is designed to deflect a blast upwardly so that ground level inspectors are not injured. The apparatus comprises a pair of spaced apart upright parallel walls 10 without any rigid structural interconnection between them, i.e., the walls are independent and separate as shown in FIG. 1. The walls 10 define a vehicular space 20 between them. Each of the walls 10 has a lower edge which is directly or indirectly supported by a common ground surface 5, when the walls 10 are erected, again as shown in FIG. 1. In this embodiment, the walls 10 are mutually joined solely by expansion members such as coil springs 30 suspended by wires 31 extending between the walls 10 and which are engaged with them as is illustrated in FIG. 5 and described below. Preferably, each of the walls 10 is joined to a horizontal ground platform 40 extending to one side of the walls 10 in a direction away from the vehicle space 20, the platform 40 resting on the common ground surface 5 and providing a surface for personnel to operate safely and to place weapons, tools and so forth. With wire cables 31 extending between the opposing walls 10, vehicle height is limited to the height of the walls 10. However, in an alternate embodiment, the expansion members may be shock absorbers 33 placed as shown in FIG. 1, or spring-loaded rigid struts mounted between walls 10 and platform 40 (not shown). It is desirable that walls 10 are able to move away from any blast and the preferred movement it to enable the walls 10 to tilt about their lower edges in an outward movement. To accomplish this safely, as shown in FIG. 8, the walls 10 are set into channels 52 and securely fastened by fastener 52'. To allow walls 10 to rotate outwardly channel 52 may be engaged with platform 40 using a resilient material such as the rubber interface 55 and using a ball headed screw 59 within channel 52. Those of skill in the art will know of alternate ways of fastening walls 10 to platform 40 while allowing walls 10 to tilt under explosive forces.

Figure 2:
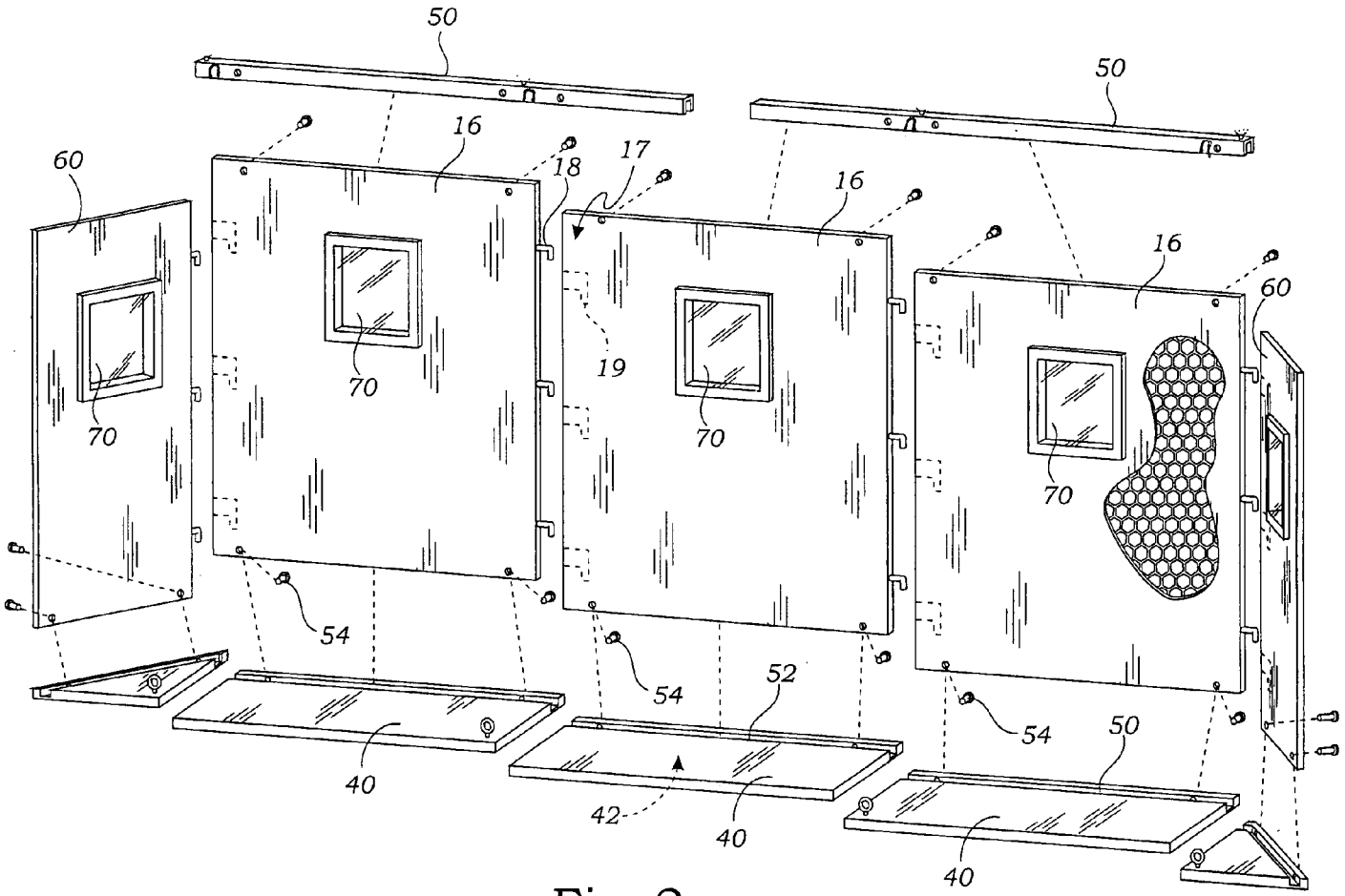
FIG. 2 is a perspective view of the major parts thereof shown in spaced apart positions.
Figure 7:
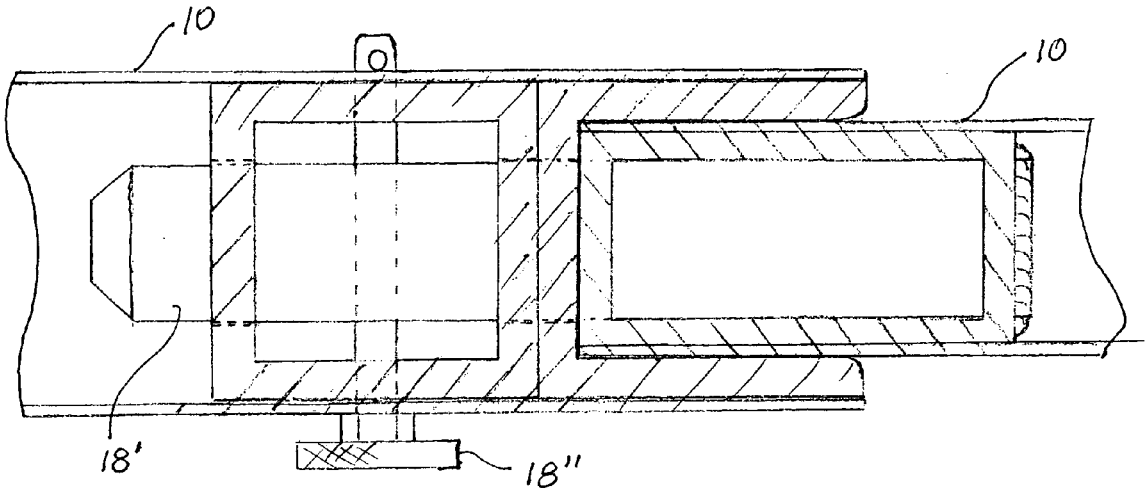
FIG. 7 is a partial sectional view taken along line 7—7 in FIG. 1.

Preferably, each of the walls 10 is made up of a plurality of frontal panels 16 joined at there mutual side edges. Such joining of the panels 16 is preferably by a mechanical means 17 that interlocks the panels 16 together such as the L-shaped hooks and slots shown in FIG. 2. Alternate locking means may be used within the scope of this disclosure, such as the straight pin 18' shown in FIG. 7 with locking pin 18".

Figure 6:
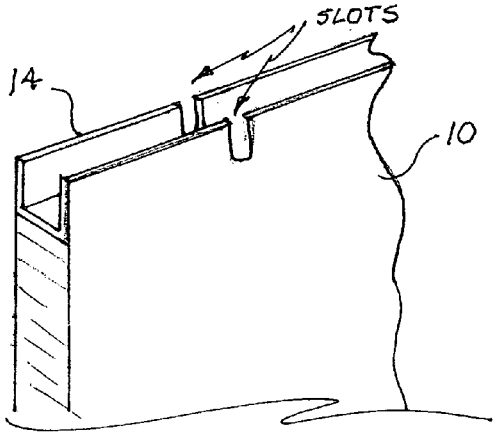
FIG. 6 is a perspective view of a portion of a panel of the invention showing cable entry slots therein.

Preferably, the expansion members 30 are coil springs engaged using cable 31 as shown in FIG. 1. Each coil spring 30 is preferably connected to the cables 31 such that cable slack is laid inside the interior of the spring 30 so that during a blast the slack of the cables 31 feeds out of the coil spring 30 before the spring 30 starts to expand. This provides for greater movement of the walls 10 as they rotate about their lower edges 12 to accommodate and deflect the blast upwardly. As shown in FIG. 5, the cables 31 extend through the upper edges 14 of the walls 10 and are securely anchored to the walls 10 by clamping block 11 which slides downwardly into channel 11' and is locked in place by channel 11" by securing pin 13. Conduit clamp 15 directs cable 31 downwardly at an angle as shown in FIG. 5 to terminate at the outside edges 42 of the platforms 40 where the cables 31 are secured. FIG. 6 shows that the walls 10 are slotted at their upper edges 14 for accepting this cable locking and fastening approach. Of course, other means for engaging the cables 31 with the walls 10 will be known by those of skill in the art.

Figure 4:
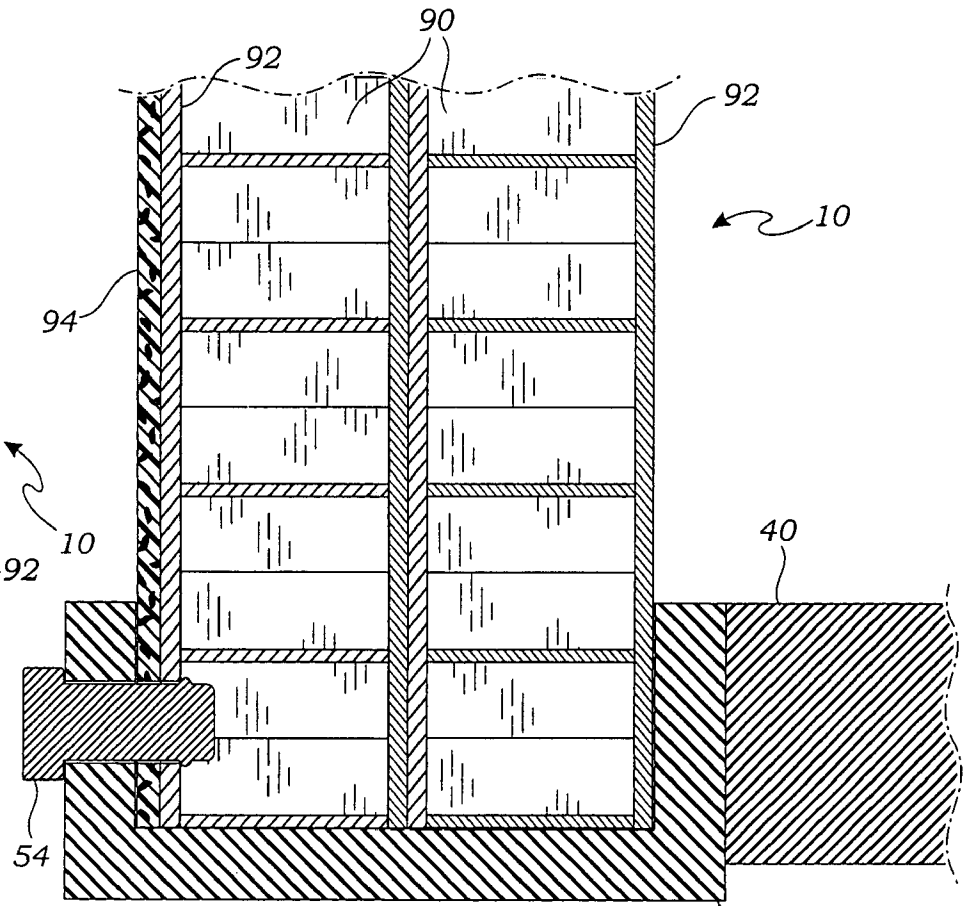
FIG. 4 is a partial sectional view taken along line 4—4 in FIG. 1.
Figure 3:
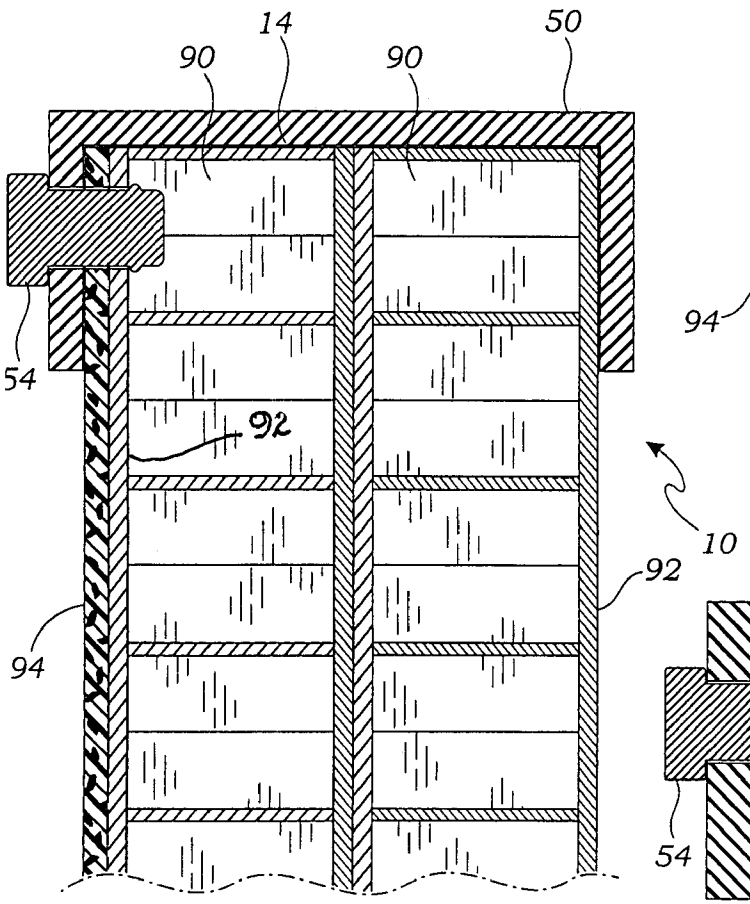
FIG. 3 is a partial sectional view taken along line 3—3 in FIG. 1.

In an alternate embodiment as shown in FIG. 3, each of the walls 10 may be secured along its upper edge 14 by a first elongate C-channel 50 and in this embodiment the cables 31 may be fastened to the tops of the channels 50 by any well known fastening means. In a similar way, walls 10 rest within elongate second C-channels 52 as shown in FIG. 4. Both first and second C-channels are anchored to walls 10 by fasteners 54. The C-channels in both FIG. 3 and FIG. 5 provide unitizing strength to the frontal panels 16 so that they function as a monolithic structure. Further, as best shown in FIG. 1, each of the walls 10 is attached in the manner described above to a pair of upright side panels 60, wherein each pair of the side panels 60 is fixed to one of the walls 10 along opposing vertical edges thereof, the side panels 60 positioned at an angle away from the vehicle space 20. This configuration is beneficial in that personnel may view approaching vehicles from behind the side panels 60 without being exposed to approaching danger. This is possible because preferably, as shown in the figures, the frontal panels 16 and side panels 60 have windows 70 in them. Such windows are made of Lexan® or a similar impact resistant material.

Preferably, spike strips 80 are placed as shown in FIG. 1 at both ends of the walls 10. extending laterally between the walls 10 and thereby defining a width of the vehicular space 20. Such a spike strip may be manually placed and then removed to allow a vehicle to enter or leave the vehicular space 20, or may be automated as is well known in the art so as to be enabled and disabled remotely.

One objective of the presently described apparatus is that it is easily erected and thereafter quickly broken-down so that it may be moved to a new location. In order to accomplish this with the least number of personnel and in the fastest time, the panels 16 and 60 must be as light in weight as possible. On the other hand, the panels 16 and 60 must be able to withstand the shock of a blast as well as prevent flying objects and particles from such a blast from penetrating walls 10. Both of these objectives are achieved in the construction details of the panels 16 and 60. Preferably, the panels 16 and 60 are made of an aluminum honeycomb structure 90 of the type described in the Terio reference, U.S. Pat. No. 4,780,020 which is incorporated herein by reference. This type of construction is extremely strong and yet relatively light in weight. To improve on the projectile resistance of the panels 16 and 60, the aluminum honeycomb structure is covered on one or both sides of these panels by sheets of steel and Kevlar® 92 and finally coated on the vehicular space side by a resilient energy absorbing layer such as rubber 94. Preferably, the panels 16 and 60 are made up of two of the structures 90 with sheets 92 as shown in FIGS. 3 and 4. The application of two structural walls 90 provides a greater strength and rupture resistance than a single one of the structures 90 having twice the thickness. The platforms 40 are made of similar structure and materials as walls 10 and are preferably about 3 inches in thickness.

In use, the present apparatus may be moved by road, rail or air to a site where a military or civilian vehicle check point is desired. After being unloaded from transport, the panels 16 and 60 are easily interconnected, channels 50 and 52 set on top and bottom, cables 31 engaged with the walls 10 with coil springs 30, and spike strips 80 placed. When the apparatus is needed elsewhere, the entire assembly process is reversed, panels stacked in transport and then moved to an alternate location. Upon the occurrence of a blast between the walls 10, personnel standing on the platforms 40 are generally protected as the walls 10 react by rotation about their bottom edges 12 to direct energy upwardly and to deflect or absorb shrapnel. Generally, the present apparatus is designed to be placed over an existing road and wire or fencing would be erected on either side of the road to force oncoming traffic into the present check point apparatus rather than allowing such vehicles to go around it.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An explosion protective shelter apparatus comprising: a pair of spaced apart independent parallel walls defining a vehicular space therebetween, the walls supported by a common ground surface in an upright attitude, and engaged by at least one coil spring positioned for restoring the walls to the upright attitude upon deflection of said walls due to an explosive force.

2. The apparatus of claim 1 wherein each of the walls is joined to a horizontal platform extending away from the vehicle space, the platforms resting on the common ground surface.

3. The apparatus of claim 1 wherein each of the walls is comprised of a plurality of frontal panels removably joined at mutual edges thereof.

4. The apparatus of claim 1 wherein the at least one coil spring is attached to a cable.

5. The apparatus of claim 2 wherein the walls are flexibly engaged with the platforms.

6. The apparatus of claim 1 wherein each of the walls provides a pair of upright side panels, fixed to the walls along opposing vertical edges thereof, the side panels positioned at an angle away from the vehicle space.

7. The apparatus of claim 1 wherein at least one of the frontal panels and side panels has a window therein.

8. The apparatus of claim 1 further comprising at least one spike strip extending laterally between the walls and thereby defining a width of the vehicular space.

9. The apparatus of claim 1 wherein the frontal and side panels and the platforms are formed of layers of aluminum and poly-paraphenylene terephthalamide.

10. The apparatus of claim 1 wherein the frontal and side panels are each formed of abutting layers of aluminum honeycomb construction with an outer skin layer of at least one of metal and poly-paraphenylene terephthalamide.

11. The apparatus of claim 1 wherein the walls are coated with an energy absorbing material.

12. The apparatus of claim 1 wherein the at least one coil spring is a part of a spring-loaded strut.

13. The apparatus of claim 12 wherein each of the walls is joined to a horizontal platform extending away from the vehicle space, the platforms resting on the common ground surface.

14. The apparatus of claim 12 wherein each of the walls is comprised of a plurality of frontal panels removabley joined at mutual edges thereof.

15. The apparatus of claim 12 wherein the walls are flexibly engaged with the platforms.

16. The apparatus of claim 12 wherein each of the walls provides a pair of upright side panels, fixed to the walls along opposing vertical edges thereof, the side panels positioned at an angle away from the vehicle space.

17. The apparatus of claim 12 wherein at least one of the frontal panels and side panels has a window therein.

18. The apparatus of claim 12 further comprising at least one spike strip extending laterally between the walls and thereby defining a width of the vehicular space.

19. The apparatus of claim 12 wherein the frontal and side panels and the platforms are formed of at least one of: layers of aluminium and poly-paraphenylene terephthalamide abutting layers of aluminum honeycomb construction with an outer skin layer of at least one of metal and poly-paraphenylene terephthalamide and an energy absorbing material.

20. The apparatus of claim 1 wherein the at least one coil spring is suspended by wires between the parallel walls.

* * * * *